US009330608B2

(12) United States Patent
Qiu

(10) Patent No.: US 9,330,608 B2
(45) Date of Patent: May 3, 2016

(54) POWER MANAGEMENT METHOD AND DISPLAY DEVICE THEREOF

(71) Applicant: Wistron Corp., New Taipei (TW)

(72) Inventor: JunXin Qiu, New Taipei (TW)

(73) Assignee: WISTRON CORP., New Taipei (TW)

( * ) Notice: Subject to any disclaimer, the term of this patent is extended or adjusted under 35 U.S.C. 154(b) by 135 days.

(21) Appl. No.: 14/306,624

(22) Filed: Jun. 17, 2014

(65) Prior Publication Data

US 2015/0199940 A1 Jul. 16, 2015

(30) Foreign Application Priority Data

Jan. 16, 2014 (CN) ..... 2014 1 0021090

(51) Int. Cl.
*G09G 3/34* (2006.01)

(52) U.S. Cl.
CPC ..... *G09G 3/3406* (2013.01); *G09G 2320/06* (2013.01); *G09G 2320/0626* (2013.01); *G09G 2330/021* (2013.01); *G09G 2330/04* (2013.01)

(58) Field of Classification Search
None
See application file for complete search history.

(56) References Cited

U.S. PATENT DOCUMENTS 6,618,042 B1 * 9/2003 Powell ..... G06F 1/263 345/204
7,129,679 B2 * 10/2006 Inaba ..... H02M 3/156 323/222
7,567,245 B2 * 7/2009 Mamata ..... G09G 3/20 345/102
7,624,202 B2 11/2009 Monks et al.
8,569,910 B2 10/2013 Dunn et al.

(Continued)

FOREIGN PATENT DOCUMENTS

JP 2012-518816 8/2012
TW 591585 6/2004
TW 200705729 2/2007

(Continued)

OTHER PUBLICATIONS

Chinese language office action dated Nov. 10, 2015, issued in application No. TW 103106959.

(Continued)

*Primary Examiner* — Seokyun Moon
(74) *Attorney, Agent, or Firm* — McClure, Qualey & Rodack, LLP

(57) ABSTRACT

A power management method a display device utilizes the same are disclosed. The power management method, adopted by the display device, includes: increasing, by a control circuit, brightness of a lighting device, wherein the lighting device is configured to illuminate a display panel device; detecting, by an overload detection circuit, whether an overload has been triggered by the increased brightness; and when the overload has been triggered by the increased brightness, recording, by a power capacity determination circuit, a maximal predetermined brightness that is used prior to the overload is triggered, while showing an on-screen-display (OSD) warning message on a display of the display device for reminding the user. When the brightness of the lighting device reaches the maximal predetermined brightness and the power capacity determination circuit detects no overload, this indicates the power capacity is sufficient for supplying power to the display device.

16 Claims, 3 Drawing Sheets

(56) References Cited

U.S. PATENT DOCUMENTS

| | | | | |
|---|---|---|---|---|
| 2007/0247544 | A1* | 10/2007 | Imamura | H04N 5/23245 348/366 |
| 2008/0315785 | A1* | 12/2008 | Price | H05B 41/282 315/277 |
| 2009/0109246 | A1* | 4/2009 | Oh | G09G 3/3406 345/690 |
| 2012/0299941 | A1* | 11/2012 | Lee | G09G 3/3406 345/582 |
| 2013/0141453 | A1* | 6/2013 | Devara | G09G 5/10 345/589 |

FOREIGN PATENT DOCUMENTS

| | | |
|---|---|---|
| TW | I356295 | 1/2012 |
| TW | 201242431 | 10/2012 |

OTHER PUBLICATIONS

English language translation of relevant paragraphs of office action.
English language translation of abstract of TW 591585.
English language translation of relevant paragraphs of TW 200705729.

* cited by examiner

POWER MANAGEMENT METHOD AND DISPLAY DEVICE THEREOF

CROSS REFERENCE TO RELATED APPLICATIONS

This Application claims priority of China Patent Application No. CN201410021090.2, filed on Jan. 16, 2014, the entirety of which is incorporated by reference herein.

BACKGROUND

1. Field

The present disclosure relates to display technology, and in particular, to a power management method and a display device thereof.

2. Description of the Related Art

In recent years, devices utilizing USB interfaces for supplying power have been increasing in popularity. For example, portable devices such as mobile phones, music players, tablet computers, displays, and so on use these interfaces. These devices are charged through USB interfaces from a USB power source or from a power supply. The USB power source and the power supply may be a desktop computer or a laptop computer which is capable of providing power. When the power capacity of a USB power source is insufficient, the connected device will result in an overload and no screen display will be shown thereon, leading to a bad user experience.

BRIEF SUMMARY OF THE DISCLOSURE

A detailed description is given in the following embodiments with reference to the accompanying drawings.

An embodiment of a power control method is disclosed, performed by a communication device, comprising: determining a power range of a transmission power of an uplink signal; determining a gain switch range based on the power range; when the transmission power of the uplink signal is within the gain switch range, determining a first gain mode for amplifying the uplink signal; and when the transmission power of the uplink signal is out of the gain switch range, determining a second gain mode for amplifying the uplink signal.

Another embodiment of a communication device is provided, comprising a controller and a power amplifier. The controller is configured to determine a power range of a transmission power of an uplink signal, and determine a gain switch range based on the power range, and when the transmission power of the uplink signal is within the gain switch range, determine a first gain mode, and when the transmission power of the uplink signal is out of the gain switch range, determine a second gain mode. The power amplifier, coupled to the controller, is configured to amplify the uplink signal with the first or the second gain mode.

BRIEF DESCRIPTION OF THE DRAWINGS

The present disclosure can be more fully understood by reading the subsequent detailed description and examples with references made to the accompanying drawings, wherein.

DETAILED DESCRIPTION OF THE DISCLOSURE

The following description is of the best-contemplated mode of carrying out the disclosure. This description is made for the purpose of illustrating the general principles of the disclosure and should not be taken in a limiting sense. The scope of the disclosure is best determined by reference to the appended claims.

Figure 1:
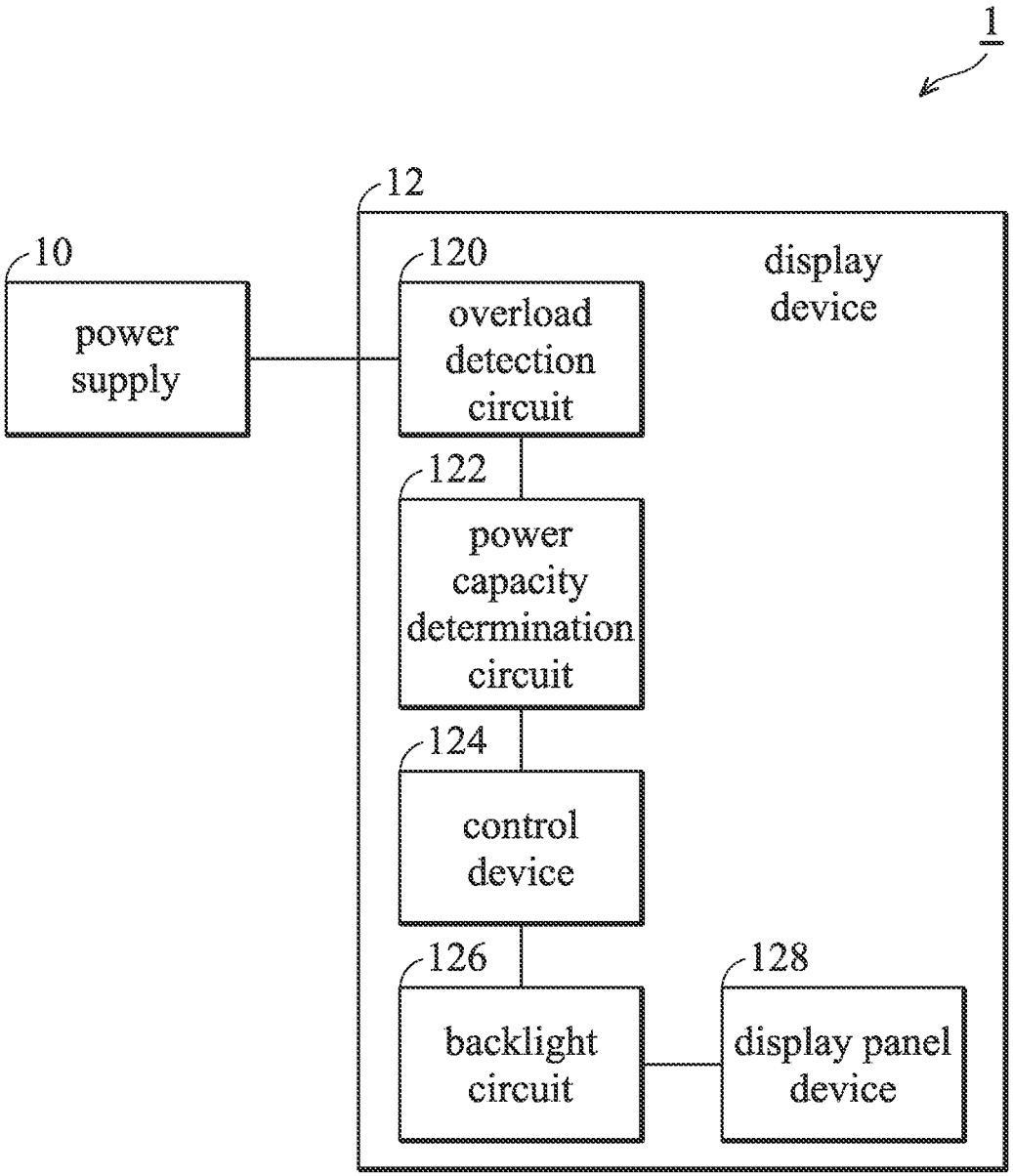
FIG. 1 is a block diagram of a display system for automatic power management according to an embodiment of the invention.

FIG. 1 is a block diagram of a display system for automatic power management according to an embodiment of the invention, including a power supply 10 and a display device 12. The display device 12 further contains an overload detection circuit 120, a power capacity determination circuit 122, a control circuit 124, a backlight circuit 126 (light source), and a display panel device 128. The display device 12 is connected to the power supply 10 through a power cable or a universal serial bus (USB) cable. The power supply 10 may be any type of power supply or power adapter, and particularly those compliant with USB specifications. For example, the power supply 10 may be a desktop computer, a laptop computer, an optical drive, or a USB power adapter. The display device 12 may be a handset, a music player, a tablet computer, a handheld game console, a USB port monitor, or other consumer electronics. The display device 12 can automatically detect the power which can be supplied by the power supply 10, and adjust device loading of the display device 12 accordingly, thereby drawing appropriate power from the power supply 10 without causing an overload.

After the display device 12 is connected to the power supply 10, the overload detection circuit 120 can receive a power signal through the power cable. The overload detection circuit 120 can determine the occurrence of an overload based on the power signal. An overload occurs when the power supply 10 cannot provide sufficient currents to drive the load of the display device 12. The overload detection circuit 120 may include a Schmitt trigger or a comparator, comparing the power signal with a predetermined value to detect occurrence of the overload. For example, the overload detection circuit 120 may detect an over-current or under-voltage condition, and determine that the overload occurs whenever an over-current or under-voltage condition has been detected, and send an overload signal to the power capacity determination circuit 122, indicating the overload has been detected.

The power capacity determination circuit 122 may be a controller, processor, microcontroller, or microprocessor. The power capacity determination circuit 122 is coupled to the overload detection circuit 120, the controller circuit 124 and the display panel device 128, and controls the operation of the circuits and devices which are connected thereto. The power capacity determination circuit 122 can operate the control circuit 124 to increase or decrease the brightness of the backlight circuit 126. The power capacity determination circuit 122 can conduct an automatic power management scheme for the display device 12. The automatic power management scheme may be implemented in hardware circuits or software or firmware codes. When the display device 12 is powered on, the power capacity determination circuit 122 controls the backlight circuit 126 to operate at a low brightness, and the overload detection circuit 120 detecting whether the configured brightness of the backlight circuit 126 can cause an overload. If the overload does not occur, the controller circuit 124 can increase the brightness of the backlight circuit 126, following by the overload detection circuit 120 detects an overload, and the processes continue until an overload occurs. When the power capacity determination circuit 122 receives an overload signal, it can store a maximal predetermined brightness which the backlight circuit 126 employs just before the overload occurs, and the control circuit 124 can configure the brightness of the backlight circuit 126 to be the maximal predetermined brightness, and the display panel device 128 can inform the overload thereon. If the power capacity determination circuit 122 receives no overload signal after the brightness of the backlight device 126 has been continuously increased until a maximum predetermined brightness is reached, this indicates that the power supply 10 has sufficient power capacity to provide for the display device 12, and the display device 12 can operate at any brightness which the user chooses to use.

In certain embodiments, the power capacity determination circuit 122 can check for an overload via the overload detection circuit 120 on a regular basis, e.g., every 20 seconds. Once an overload is detected, the power capacity determination circuit 122 can once again execute the automatic power management scheme, that is, the control circuit 124 gradually increases the backlight circuit 126 from the lowest brightness onwards, and determines whether the brightness of the backlight circuit 126 triggers the overload, thereby finding a maximal predetermined brightness which the power supply 10 is capable of providing. In other embodiments, when the power supply 10 is unable to provide power for the backlight circuit 126 to support the lowest brightness after power-up, the control circuit 124 will not turn on the display panel device 128. The brightness of the backlight circuit 126 is controlled by the control circuit 124 for illuminating the display panel device and displaying images on the screen. The display panel device 128 may be a Cathode ray tube (CRT) monitor or Liquid Crystal Display (LCD) monitor, or other display devices such as an Organic Light-Emitting Diode (OLED) device.

In the embodiment, the display device 12 can automatically detect the power which the power supply 10 can supply thereto, and adjust the device loading of the display device 12 to acquire an appropriate power from the power supply 10 without causing an overload, providing an intelligent power detection mechanism to prevent the display device 12 and the power supply 10 from being damaged.

Figure 2:
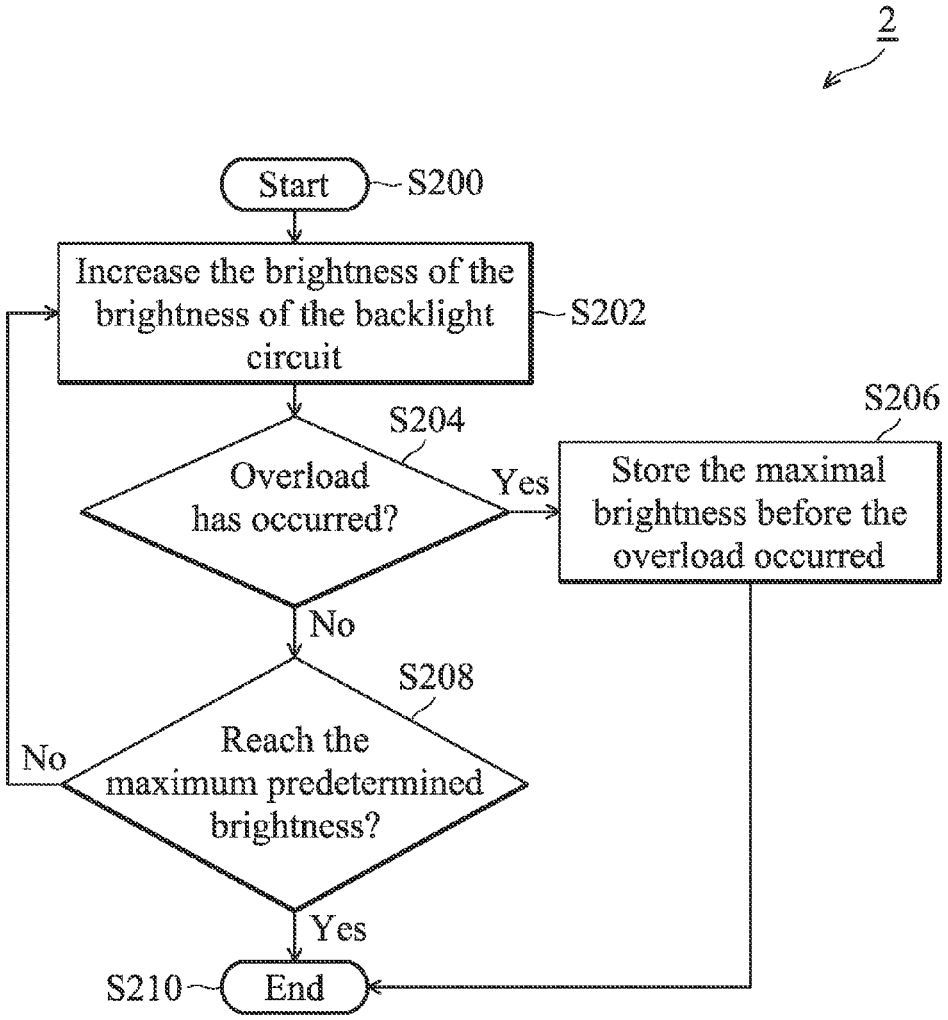
FIG. 2 is a flowchart of a power management method 2 according to an embodiment of the invention.

FIG. 2 is a flowchart of a power management method 2 according to an embodiment of the invention, incorporating the display system 1 in FIG. 1.

Upon startup of the power management method 2, the circuits and components of the display device 12 are initialized, and ready to perform power management (S200). Because the display device 12 has just powered on, the power capacity determination circuit 122 is configured to gradually adjust the backlight circuit 126 from the lowest brightness onwards via the control circuit 124. After each time the brightness of the backlight circuit 126 is increased, the power capacity determination circuit 122 can detect the occurrence of an overload via the overload detection circuit 120 (S204). The overload may be an over-current or under-voltage condition. For detecting the under-voltage condition, the overload detection circuit 120 is configured to compare the voltage level of the supplied power signal to a threshold voltage, e.g., 4V. When the voltage level is less than the threshold voltage, the overload detection circuit 120 is configured to determine that an overload has occurred. For detecting the over-current condition, the overload detection circuit 120 is configured to compare the current level of the supplied power signal to a threshold current. When the current level exceeds the threshold current, the overload detection circuit 120 is configured to determine that an overload has occurred. Upon detecting the overload, the overload detection circuit 120 can transmit an overload signal to the power capacity determination circuit 122.

When an overload occurs, the power capacity determination circuit 122 is configured to save the maximal predetermined brightness before the overload occurred (S206), show an overload warning message on the display panel device 128, and set the maximal predetermined brightness as the brightness of the backlight circuit 126. When an overload does not occur, the power capacity determination circuit 122 is configured to continue its determination of that whether the backlight circuit 126 has reached a maximum predetermined brightness (S208). The power capacity determination circuit 122 can determine whether the backlight circuit 126 has reached the maximum predetermined brightness via a comparator (not shown).

When the backlight circuit 126 has not yet reached the maximum predetermined brightness, the power capacity determination circuit 122 can continue increasing the brightness of the backlight circuit 126 via the control circuit 124 (S202), and again perform the loop of Steps S202 through S208. If the backlight circuit 126 has reached the maximum predetermined brightness and no overload has been detected, then the power capacity determination circuit 122 can configure the brightness of the backlight circuit 126 to be a user preference or a manufacturer default via the control circuit 124. The power management method 2 is then completed and exited (S210).

In the embodiment, the power management method 2 utilizes the display device 12 to automatically detect the power which the power supply 10 can supply thereto, and adjust the device loading of the display device 12 to acquire an appropriate level of power from the power supply 10 without causing an overload, providing an intelligent power detection mechanism to prevent the display device 12 and the power supply 10 from being damaged.

Figure 3:
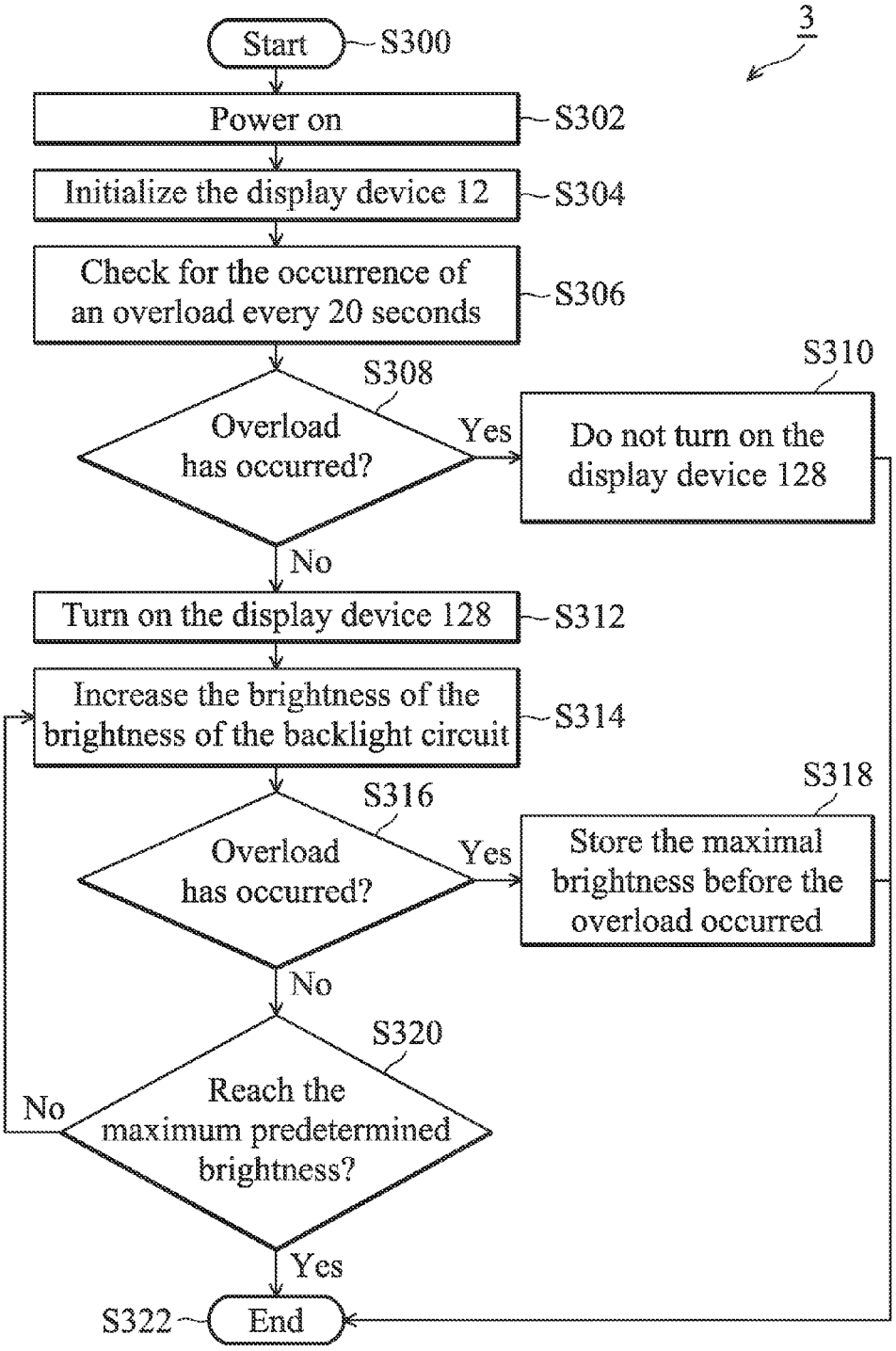
FIG. 3 is a flowchart of a power management method 3 according to another embodiment of the invention.

FIG. 3 is a flowchart of a power management method 3 according to another embodiment of the invention, incorporating the display system 1 in FIG. 1.

Upon startup of the power management method 3 (S300), the display device 12 is turned on (S302) and the internal circuits and components of the display device 12 are initialized, ready for performing the power management (S304). Because the display device 12 has just powered on, the power capacity determination circuit 122 is configured to gradually adjust the backlight circuit 126 from the lowest brightness onwards via the control circuit 124. For example, the power capacity determination circuit 122 can detect the overload via the via the overload detection circuit 120 every 20 seconds (S306).

If the overload is detected, the power capacity determination circuit 122 is configured to determine that the power supply 10 cannot supply any power to the display device 12 (S308), thus the display device will not turn on the display panel device 128 (S310). If the overload is not detected, the power capacity determination circuit 122 is configured to determine that the power supply can supply power to the display device (S308), consequently the display panel device 18 is turned on (S312), and the loading of the display device 12 is increased by increasing the brightness of the backlight circuit 126 (S314).

Each time after the brightness of the backlight circuit 126 is increased, the power capacity determination circuit 122 is configured to detect the occurrence of the overload via the overload detection circuit 120 (S316). The overload may be an over-current or under-voltage condition. For detecting the under-voltage condition, the overload detection circuit 120 is configured to compare the voltage level of the supplied power signal to a threshold voltage, e.g., 4V. When the voltage level is less than the threshold voltage, the overload detection circuit 120 is configured to determine that an overload has occurred. For detecting the over-current condition, the overload detection circuit 120 is configured to compare the current level of the supplied power signal to a threshold current. When the current level exceeds than the threshold current, the overload detection circuit 120 is configured to determine that an overload has occurred. Upon detecting the overload, the overload detection circuit 120 can transmit an overload signal to the power capacity determination circuit 122.

When the overload occurs, the power capacity determination circuit 122 is configured to save the maximal brightness before the overload occurs as a maximal predetermined brightness (S318), display an overload warning message on the display panel device 128, and set the maximal predetermined brightness as the brightness of the backlight circuit 126. When the overload does not occur, the power capacity determination circuit 122 is configured to continue determining that whether the backlight circuit 126 has reached a maximum predetermined brightness (S320). The power capacity determination circuit 122 can determine whether the backlight circuit 126 has reached the maximum predetermined brightness via a comparator.

When the backlight circuit 126 has not yet reached the maximum predetermined brightness, the power capacity determination circuit 122 can continue increasing the brightness of the backlight circuit 126 via the control circuit 124 (S314), and again perform the loop of Steps S314 through S320. If the backlight circuit 126 has reached the maximum predetermined brightness and no overload has been detected, then the power capacity determination circuit 122 can configure the brightness of the backlight circuit 126 to be a user preference or a manufacturer default via the control circuit 124. The power management method 2 is then completed and exited (S322).

In the embodiment, the power management method 3 utilizes display device 12 to automatically detect the power which the power supply 10 can supply thereto, and adjust the device loading of the display device 12 to acquire an appropriate power from the power supply 10 without causing an overload, providing an intelligent power detection mechanism to prevent the display device 12 and the power supply 10 from being damaged.

As used herein, the term "determining" encompasses calculating, computing, processing, deriving, investigating, looking up (e.g., looking up in a table, a database or another data structure), ascertaining and the like. Also, "determining" may include resolving, selecting, choosing, establishing and the like.

The various illustrative logical blocks, modules and circuits described in connection with the present disclosure may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any commercially available processor, controller, microcontroller or state machine.

The operations and functions of the various logical blocks, modules, and circuits described herein may be implemented in circuit hardware or embedded software codes that can be accessed and executed by a processor.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power management method, performed by a display device, comprising:

increasing, by a control circuit, a brightness of a light source device, wherein the light source device is configured to illuminate a panel display device;

determining, by an overload detection circuit, whether the increased brightness triggers an overload; and when the increased brightness triggers the overload, recording, by a power capacity determination circuit, a maximal brightness before the overload is triggered as a maximal predetermined brightness.

2. The power management method of claim 1, further comprising:

when the increased brightness does not trigger the overload, continuing to increase the brightness of the light source device.

3. The power management method of claim 1, further comprising:

when the increased brightness is less than a maximum predetermined brightness, increasing the brightness of the light source device.

4. The power management method of claim 1, further comprising:

detecting, by the overload detection circuit, an occurrence of the overload in a predetermined period.

5. The power management method of claim 1, wherein the step of determining whether the increased brightness triggers the overload comprises:

detecting, by the overload detection circuit, a voltage level from a power source; and when the voltage level is less than a voltage threshold, determining the overload is triggered.

6. The power management method of claim 1, wherein the step of determining whether the increased brightness triggers the overload comprises:

detecting, by the overload detection circuit, a current level from a power source; and when the current level exceeds a current threshold, determining the overload is triggered.

7. The power management method of claim 1, further comprising:

adjusting, by the control circuit, the brightness of the light source device to be the maximal predetermined brightness when the increased brightness triggers the overload.

8. The power management method of claim 1, further comprising:

when the increased brightness triggers the overload, displaying, by the panel display device, a warning message about the overload.

9. A display device, performing a power management method, comprising:

a panel display device;

a light source device, configured to illuminate the panel display device;

a control circuit, configured to increase a brightness of the light source device;

an overload detection circuit, configured to determine whether the increased brightness triggers an overload; and a power capacity determination circuit, when the increased brightness triggers the overload, configured to record a maximal brightness before the overload is triggered as a maximal predetermined brightness.

10. The display device of claim 9, wherein:

when the increased brightness does not trigger the overload, the control circuit is configured to continue to increase the brightness of the light source device.

11. The display device of claim 9, wherein:

when the increased brightness is less than a maximum predetermined brightness, the control circuit is configured to increase the brightness of the light source device.

12. The display device of claim 9, wherein:

the overload detection circuit is configured to detect an occurrence of the overload in a predetermined period.

13. The display device of claim 9, wherein:

the overload detection circuit is configured to detect a voltage level from a power source, and when the voltage level is less than a voltage threshold, determine the overload is triggered.

14. The display device of claim 9, wherein:

the overload detection circuit is configured to detect, by the overload detection circuit, a current level from a power source, and when the current level exceeds a current threshold, determine the overload is triggered.

15. The display device of claim 9, wherein:

the control circuit is configured to adjust the brightness of the light source device to be the maximal predetermined brightness when the increased brightness triggers the overload.

16. The display device of claim 9, wherein:

when the increased brightness triggers the overload, the panel display device is configured to display a warning message about the overload.

* * * * *